US005555840A

United States Patent [19]

Fougere

[11] Patent Number: 5,555,840

[45] Date of Patent: Sep. 17, 1996

[54] DART GAME SCORE BOARD

[76] Inventor: Willard F. Fougere, 37 Surrey Run, The Paddock, Dover, N.H. 03820

[21] Appl. No.: 235,972

[22] Filed: May 2, 1994

[51] Int. Cl.[6] ..... G09F 11/12; G09F 11/02; A63F 9/02

[52] U.S. Cl. ..... 116/223; 116/278; 116/309; 116/316

[58] Field of Search ..... 40/118, 524, 525; 116/223, 278, 309, 316, 317, 322; 235/1 B, 1 C; 273/DIG. 26

[56] References Cited

U.S. PATENT DOCUMENTS

| | | | |
|---|---|---|---|
| 700,738 | 5/1902 | Carter | 235/125 |
| 783,955 | 2/1905 | Hirsch | 235/125 |
| 835,844 | 11/1906 | Bewan | 273/148 |
| 1,812,600 | 6/1931 | Martin | 40/524 |
| 1,953,630 | 10/1932 | Phillips | 235/90 |
| 2,945,312 | 7/1960 | Book | 116/317 X |
| 4,003,579 | 1/1977 | Miscavage | 273/148 |
| 4,258,491 | 3/1981 | Ernst et al. | 40/524 |
| 4,567,461 | 1/1986 | Honekman et al. | 340/323 |
| 4,651,998 | 4/1987 | Holt et al. | 273/347 |
| 4,948,148 | 8/1990 | Danielson | 273/408 |
| 5,438,950 | 8/1995 | Rodrigues | 116/222 |

FOREIGN PATENT DOCUMENTS

| | | | |
|---|---|---|---|
| 124399 | 6/1947 | Australia | 116/223 |

*Primary Examiner*—William A. Cuchlinski, Jr.
*Assistant Examiner*—Willie Morris Worth
*Attorney, Agent, or Firm*—Robert E. Brunson

[57] ABSTRACT

A dart game score board includes a case having a plurality of walled compartments therein. A removable front cover of the case forms one wall of the compartments, with the front cover having formed therein a plurality of groups of window openings arranged in a prescribed pattern and the window openings of each group aligned with a corresponding one of the walled compartments. A plurality of scoring modules are removably inserted in each of the walled compartments, with one scoring module aligned with a corresponding window opening. Each scoring module has a rotatable spool extending through a window opening to enable indicia on the spools to be displayed to keep score during play by one or more players.

10 Claims, 3 Drawing Sheets

FIG. 1
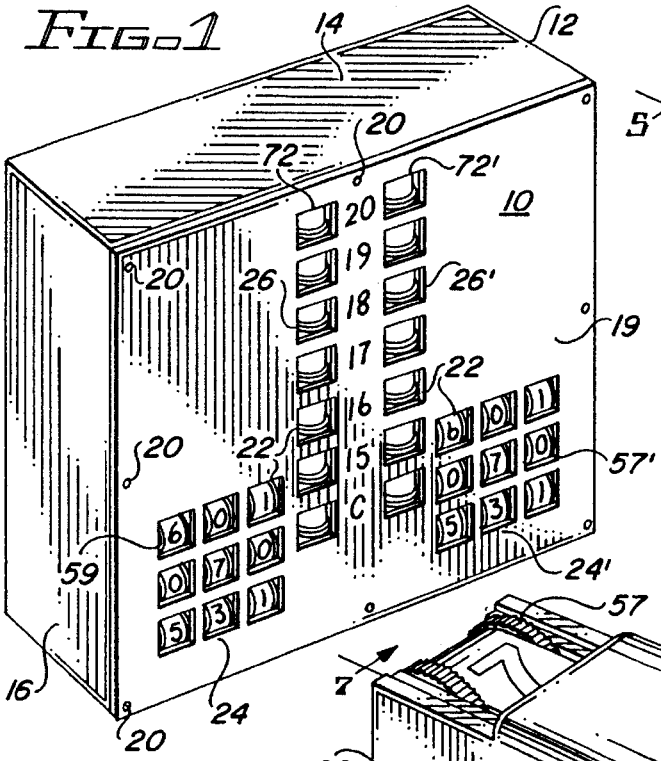
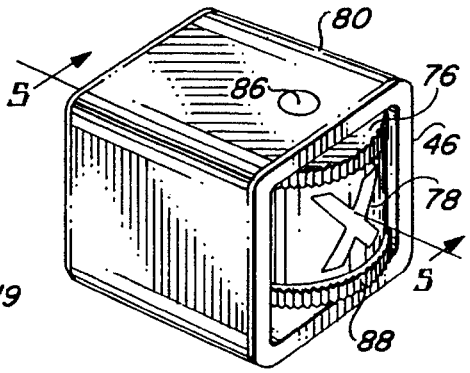
FIG. 4
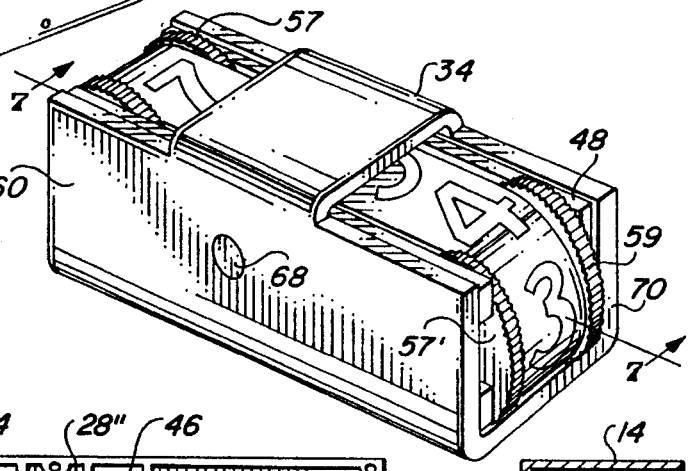
FIG. 6
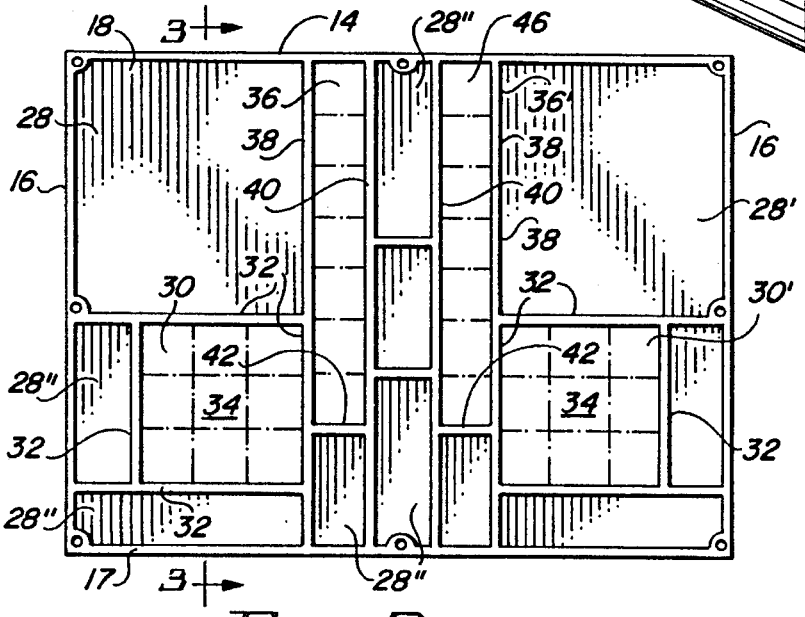
FIG. 2
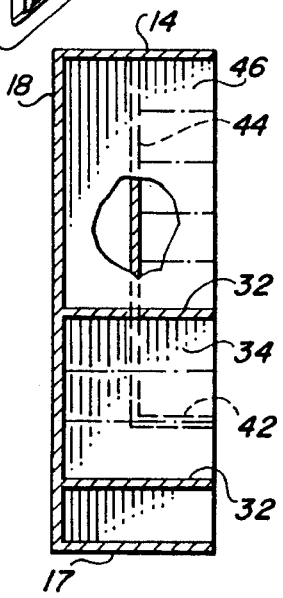
FIG. 3

DART GAME SCORE BOARD

BACKGROUND OF THE INVENTION

1. Field of the Invention

The present invention relates generally to game score boards and more particularly to score boards for keeping the scores of single and multiple players playing the various games of darts.

2. Description of the Prior Art

Darts is a game which may be played in a variety of ways. While all dart games employ a target and a group of throwing darts for each opponent, the manner in which a game may be played and scored can be varied in many ways. The game of darts has evolved into a number of different games, each having a different set of rules as well as different scoring arrangements. The games differ primarily in the arithmetics involved by which the individual scores obtained by each of the players, throwing successive sets of darts at the target, are added or subtracted to achieve a winning score. Some of these games have rather elaborate or complex scoring rules, whereas the scoring rules for other games is less complex.

The "standard game" of darts among the majority of dart players is probably the most popular. The game starts with an initial score which may be 301, 401, 501, 701, etc. The object of the standard game is to get rid of points. This reduction of points is accomplished by each player, in turn, throwing a set of three darts. A set score is obtained by adding the numbers of the dart board segments on which each of the three darts has landed. This set score is subtracted from the beginning score (e.g. 301 if that score is chosen as the beginning or initial score). The set score achieved by each player taking his turn throwing the set of three darts is subtracted from the beginning score of each player to obtain a first intermediate score for each player. Successive sets of three darts are thrown by turns of the opposing players to obtain further intermediate scores by subtracting each intermediate score from the previous corresponding intermediate score of each player to further reduce the scores of the respective players. The game ends when a player's last dart is thrown and the scoring of that dart is twice (referred to as a double) the number equal to one half the last intermediate score of that player throwing his dart.

The above standard game is one class of games wherein intermediate scores are subtracted from a beginning score. A second popular game, referred to generally as "cricket", is somewhat more complex than the standard game and differs from that game in that intermediate scores are added to accumulate a final or ending score.

In the game of cricket the players are required to score three dart landings in each of the dart board beds (also referred to as pies) numbered 15 through 20 plus three darts in the bullseye. Each number (15–20) represents scoring possibilities. In addition, as is well known in the standard game of darts, doubles and trebles when hit by a dart are worth their normal values. To score on a particular number, a player must bring that number alive by hitting it three times. Once accomplished, any dart thrown into that number by that player with it alive scores. If the opponent places three darts in that same live number, that number becomes dead (i.e., it is no longer in the game). In the game of cricket, the beginning score is zero and successive score points are added to keep an increasing total of the point scores for each player. Thus a cumulative point score is kept for each of the players. The winner of the game is the player who first lands three darts in each of the beds, or pies, between 15 and 20, three bulleyes, and who has the highest point score.

The above descriptions have provided the basic highlights of scoring for the various games of darts, however, those descriptions are not detailed. For detailed information regarding practically all aspects of the games of darts, reference is made to the book entitled—All About Darts, by I. L. Brackin and W. Fitzgerald, Published by Contemporary Books, Inc.; Library of Congress Catalog Card Number: 76-29366; International Standard Book Number: 0-8092-4984-7.

Historically, dart game scores have been kept by recording the scores on a chalk board. Dry erase ink boards are also sometimes used as score boards. The use of these types of score boards have several short comings. The legibility of the scores is directly dependent upon the hand writing quality of the score keeper. Because the game of darts is most frequently played in "Pubs" and "Taverns", the quality and visibility of the scores to the players and the audience may not be totally adequate for viewing. In addition, chalk dust has a tendency to accumulate on the floor and adjacent furnishings. This accumulation can require an expensive clean up problem for Tavern proprietors. Further, the chalk dust on the floor has a tendency to be tracked around the tavern by customers and players, thus necessitating further clean up expense.

Because of the foregoing short comings, attempts have been made to construct various types of mechanical, electrical and electronic score keeping devices which would eliminate the contamination and clean up problems attendant with blackboards and also provide score numbers of sufficient size for adequate viewing by the audience and the players. While these devices may eliminate the clean up problems heretofore described, they have been, for the most part, commercially unsuccessful because of the expense and inconvenience attributed to; initial cost, spare or replacement parts costs, service repair costs (i.e., labor), and/or lack of quick and easy maintainability by the owner.

Various types of dart score keeping apparatus, including other types of game score keeping devices, are known to exist and which include all mechanical apparatus, as well as electronic devices having circuits for calculating scores and displays of various types for displaying those scores. Different types of these scoring devices are disclosed in U.S. Pat. Nos.: 700,738; 783,955; 935,844; 1,953,630; 4,003,579; 4,651,998, 4,567,461; and 4,948,148.

In view of the foregoing, it can be seen that a need exists for a dart game score board apparatus which can be manufactured at reasonably low cost and which provides the attributes of: (i) ease of maintenance by the user or owner; (ii) rapid repair due to easily replaceable parts (an important feature during tournament play); (iii) large numerical display to enable players and spectators to readily see the scores of the players; (iv) allows players to play different types of dart games; and, (v) eliminates the mess historically caused by chalk board score keeping devices, thus eliminating the need for clean up and the costs associated therewith.

OBJECTS OF THE INVENTION

It is, therefore, an object of the present invention to provided a dart game score board apparatus and system having enhanced structural and operational features and capabilities.

Another object of this invention is to provide a dart game score board of the above type which is of modularized construction.

It is a further object of this invention to provide a dart game score board having a plurality of easily replaceable scoring modules useable in scoring the various games of darts.

A still further object of this invention is to provide a dart game score board having replaceable scoring modules wherein one type of module is used for scoring the game of cricket and another type of module is used for scoring the standard games of darts.

Yet another object of this invention is to provide a dart game score board of the above type wherein the different scoring modules and replacement parts may be stored inside the score board as readily accessible spares when needed.

SUMMARY OF THE INVENTION

In one aspect of the invention, a dart game score board is provided with a case having a removable front cover which has at least one orthogonal array of windows or openings formed therein for displaying indicia representative of standard dart game scores.

The case has a plurality of scoring modules, equal in number to the number of window openings in the orthogonal array, disposed inside the case. The modules are each aligned with a corresponding window in the front cover and display the above mentioned indicia. Each scoring module has opposite ends, wherein a spool is axially disposed at the end of each module. One spool of each module is aligned with a corresponding window in the front cover and protrudes through the window to enable the spool to be rotated externally of the case by a player or scorekeeper. An endless belt, having scoring indicia thereon, is frictionally disposed around the spools of each scoring module, with the indicia on each belt displayed in a window opening in the case. When the spool in the window opening is rotated, both spools on the module rotate to thus rotate the belt of each individual module and change the indicia in the respective window openings for the purpose of keeping score in the game of darts.

In another aspect of the invention, the front cover of the case further has at least one column of additional window openings for the purpose of enabling the display of further scoring indicia for playing the dart game of cricket. There is a module associated with each of these additional windows, with each module consisting of a single rotable spool having specified indicia spaced around the periphery of the spool. Means are provided in each module for axially disposing the single spools inside the case, with the spools each in alignment with an associated one of the window openings, whereby the various indicia are displayed in the respective openings when the spools are individually rotated externally of the case by a player or scorekeeper.

In a further aspect of the invention, the case includes separate walled compartments for retaining the above described modules, with one wall of each of those compartments formed by at least that portion of the case front cover having window openings therein for displaying the above described inidicia.

BRIEF DESCRIPTION OF THE DRAWINGS

The foregoing objects, advantages, and features of the present invention may be more readily understood by one skilled in the art with reference being made to the following detailed description of the preferred embodiments thereof, taken in conjunction with the accompanying drawings, in which:

FIG. 1 is a perspective view of the dart game score board of the present invention illustrating the front cover of the case including the window openings with indicia displayed in the openings.

FIG. 2 is a front view of the case of the present invention with the front cover removed and illustrating various compartments therein, including compartments for retaining the various scoring modules.

FIG. 3 is a side view of the case of the invention taken along lines 3—3 of FIG. 2.

FIG. 4 is a perspective view of one type of module used in the present invention useful in scoring the dart game of cricket.

FIG. 6 is a perspective view of a second type of scoring module used in the present invention for scoring the standard game of darts and used in conjunction with the game of cricket.

FIG. 13 is a sectional view of one part of the module of FIG. 12 and taken along lines 13—13 thereof.

FIG. 14 is a sectional view of a representative one of the spools of FIG. 12 and taken along lines 14—14 thereof.

DESCRIPTION OF THE PREFERRED EMBODIMENTS

Figure 5:
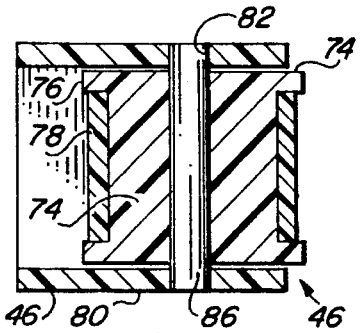
FIG. 5 is a sectional view taken along lines 5—5 of FIG. 4.

Referring now to drawings, wherein like numerals are used throughout, and in particular to FIG. 1, there is illustrated a perspective view of a dart game score board apparatus 10 (herein after generally referred as score board) in which the various features of the invention are found. The score board is of a ruggedized construction and is preferably formed of extruded, cast or injection molded high impact plastics. It is, however, understood that other types of materials can be used, such as wood, metal or highly ruggedized paper or card board.

The score board 10 is comprised of a case 12 having a top 14, sides 16, a bottom 17 and a back 18 and a removable front cover 19. As illustrated in FIG. 1, the front cover 19 is secured to the front of the case 12 by a plurality of screws or fastener means 20, so that the cover can be readily removed. The cover also could be installed with hinges and a latch; or any other type of well known attaching means, so long as it is easy to gain quick access to the inside of the case 12.

As shown in FIG. 1, the front cover has a plurality of groups of windows or openings, shown generally as 22, formed therein for displaying the scores when playing the various games of darts. There are two groups of window openings 24 and 24' arranged in first and second arrays, respectively, of three columns and three rows each. The first row of each of the arrays 24 and 24' illustrate the display of numbers for playing the standard dart game of 601. The second row of numbers, shown in each array, illustrate that each player has scored 70 on their first set of darts. As can be seen, when 70 in the second row, is subtracted from 601 in the first row, it yields, in the third row, an intermediate score for each player of 531. A more detailed description of how the numbers are changed to keep score during play will be subsequently be described.

There are two additional groups of window openings 26 and 26' arranged in two columns of 7 windows in each column. The numbers 15–20 and the letter C are printed, or otherwise inscribed on the face of the front cover 19, and separate the left column 26 from the right column 26'. These windows 26 and 26' are used to display indicia by two players when playing the dart game of cricket. The manner of scoring that game, using the score board of the invention, will be described in the ensuing description.

Reference is now made to FIG. 2, which is a front view of the case of the invention with the front cover removed. The inside of the case is partitioned into a plurality of walled compartments, some of which are used for retaining scoring modules and others of which are used for storing spare modules and parts thereof. At least two primary compartments 28 and 28' are provided for storing the larger spare parts and modules, whereas a plurality of smaller compartments 28" are provided for storing miscellaneous smaller parts. Two walled compartments 30 and 30' each have side walls 32, including the case back 18, case sides 16 and the front cover 19, for retaining scoring modules 34 of the type shown in FIG. 6 and as shown in dashed lines in FIGS. 2 and 3. The modules 34 are removably positioned in the compartments 30 and 30' as shown in FIGS. 2 and 3 to form the two arrays of modules as previously described. The modules of course are positioned so that the indicia are displayed through the window openings 24 and 24' of the front cover 19. Two additional compartments, 36 and 36', each have side walls 38,40,42 and 44, including case top 14, and the front cover 19, for retaining scoring modules 46 of the type shown in FIG. 4 and removably positioned in compartments 36 and 36' as shown in dashed lines in FIGS. 2 and 3.

Referring now to FIGS. 6,7,9,10,12,13 and 14, there is illustrated a representative one of the modules 34, each of which is designed to slide or fit into the compartments 30 and 30' to form two arrays of modules having indicia, as shown in FIG. 1, which align with the window openings 24 and 24'.

Figure 11:
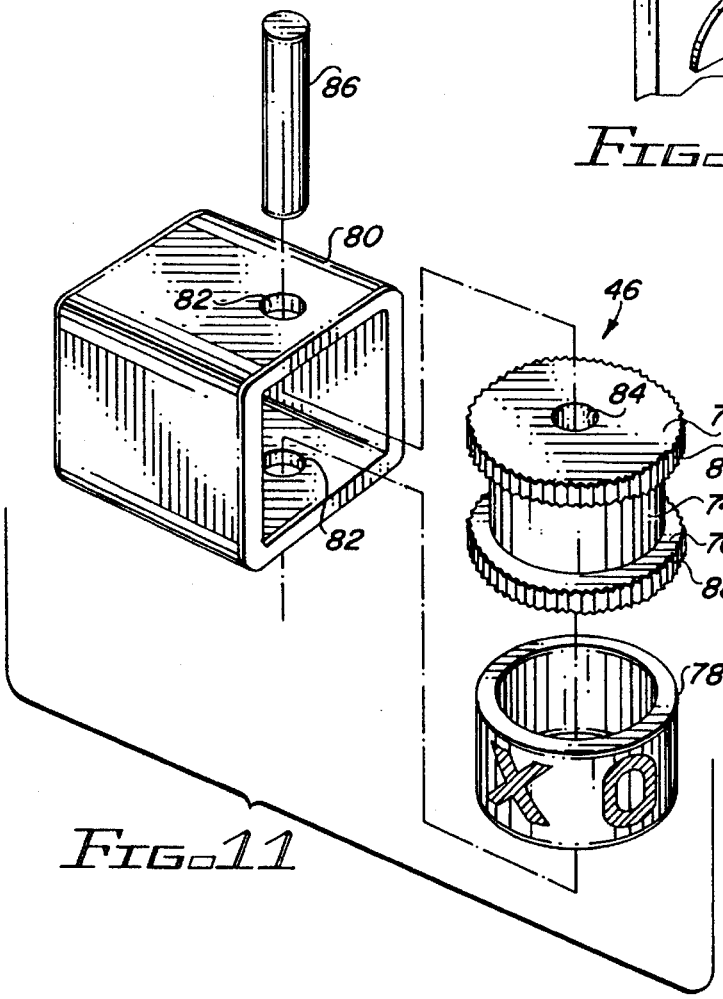
FIG. 11 is an exploded perspective view illustrating the structural details of the type of scoring module shown in FIGS. 4 and 5.
Figure 12:
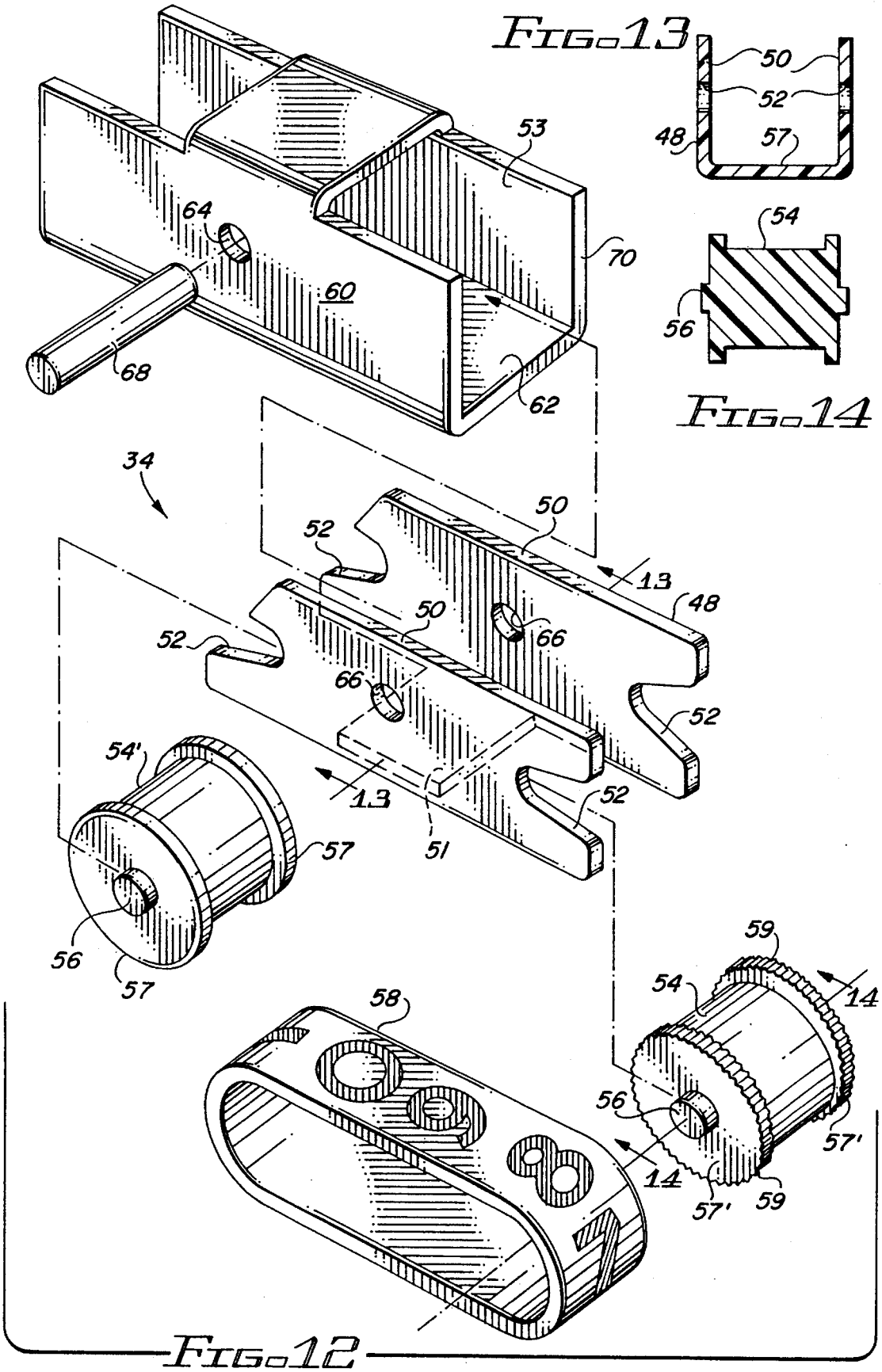
FIG. 12 is an exploded perspective view illustrating the structural details of the type of scoring module shown in FIGS. 6 and 7.

As can best be seen in FIG. 12, each module 34 is comprised of an elongated, substantially U shaped spool holder or carrier 48 having side walls 50 and a bottom wall 51 for tying the carrier together. The side walls 50 have formed in opposite ends thereof bearing surfaces 52. A pair of spools 54 and 54' each have an axle 56 formed on each end thereof. As shown in the FIG. 7, the spools fit between the side walls 50 of the carrier 48 with the axle 56 of each spool rotatably mounted in the respective bearing surfaces 52. The spools 54 can also be fabricated in a fashion similar to the spool 74 shown in FIG. 11. When a spool 74 is used in place of the spools 54, the axle pin 86 slides through the bearing surface 84 and the axle pin 86 rides in the bearing surfaces 52. Each of the spools has a shoulder 57 formed on each end thereof for retaining an endless belt 58. The belt 58 is made of elasticized material, such as rubber, stretchable plastic, or other similar materials, to thus stretch around the two spools 54 as shown in FIG. 7 and described.

Figure 7:
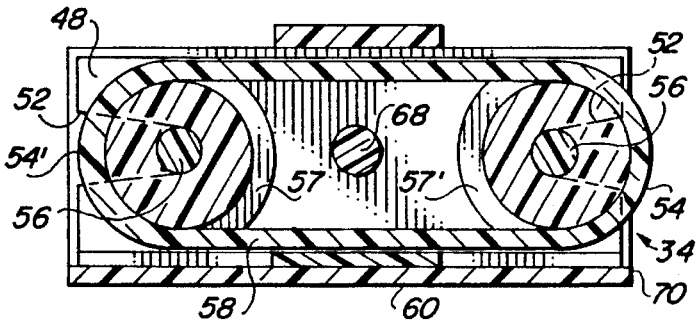
FIG. 7 is a sectional view taken along line 7—7 of FIG. 6.

While not essential to the construction of the modules 34, a rectangular tube carrier holder 60 is used to receive the spool carrier 48 as best shown in FIGS. 6,7 and 12. The spool carrier 48 is sized to slide into a channel 62 of the holder 60. As can be seen in FIG. 12, the holder 60 is provided with apertures 64 which are positioned to align with two apertures 66 formed in the side walls of the spool carrier 48. The Carrier 48 is sized to snugly slide into the channel 62 of the holder 60 whereby the apertures 64 and 66 are aligned to receive a retaining pin 68. The diameters of the retaining pin and the apertures are sized so that the retaining pin can be easily pressed into and out of the apertures. This easy installation and removal of the pin 68 is provided to enable the module to be easily and quickly assembled and dismantled for ease of manufacture as well as repair in the field.

In another embodiment of the module 34, the pin can be left out, and the carrier 48 can be permanently mounted within the holder 60 by gluing the walls 50 of the carrier to adjacent inner walls 53 of the holder 60. When the carrier is installed in the manner just described, the spools 54 and the endless belt are installed, and removed, by; (i) placing the belt around the spools 64, (ii) sliding the spools and belt 58 into the channel between the walls 50 of the carrier and holder assembly, (iii) positioning one of the spools into one of the bearing surfaces 52; and (iv) positioning the other spool in the other bearing surfaces while stretching the belt. Because the belt is elastic, the spools 54 are held in frictional engagement with the bearing surfaces 52 to thus enable the spools and the belt to be rotated.

As can best be seen in FIG. 6, when the carrier is installed in place in the holder 60, the knurling 59 on shoulder 57' extends or protrudes beyond one end 70 of the holder 60. The reason for this protrusion can best be seen in FIG. 1. The knurling 59 on the shoulder 57' of each spool 54 protrudes sufficiently beyond the end 70 of each module 34 so as to extend through the corresponding window opening in the front cover 19 so that the spool can be rotated by a player, to thus change the score which is displayed in the opening in the front cover 19.

As shown in FIGS. 2 and 3, it can be seen that the modules 34 are inserted into each of the module compartments 30 and 30' to form the two arrays 24 and 24', with each array being comprised of three rows and three columns, with nine modules to an array. It is to be understood that additional modules could be used, such as four or more in each row. The two arrays 24 and 24' are provided to enable two players or teams to play darts using the score board 10.

Figure 9:
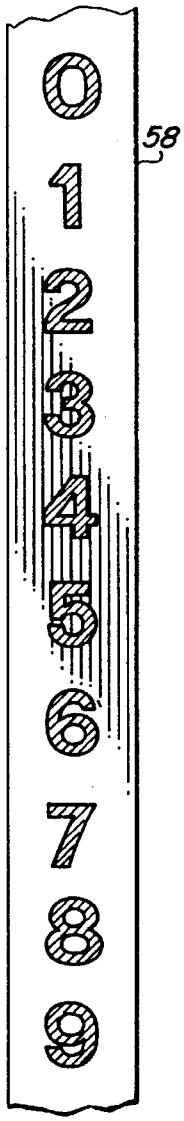
FIG. 9 is a plan view of an endless belt adapted to frictionally engage the spools of FIGS. 6 and 7 and having illustrated thereon indicia useful in scoring the various games of darts.

Dart scores are registered or displayed by indicia imprinted, embossed, or otherwise affixed to the endless belt 58. In the embodiment shown in FIG. 10, the numbers are raised on the belt 58 in a manner similar to a conventional rubber stamp. As shown in FIG. 9 these indicia are represented by the numerals 0–9, to thus allow the numbers in each row of modules to be adjusted, by rotation of the knurled spools 54, between 000–999. In FIG. 1, as previously described, the first, second and third rows of each array have been adjusted to display the numbers 601,70 and 531 respectively.

Referring again to FIG. 1, the second group of window openings (shown as 26 and 26') in the front cover 19 are arranged in two adjacent columns 72 and 72'. Further indicia, shown as numbers 15–20 and the letter C (representative of the center of bulls eye on the conventional dart board) are imprinted or otherwise inscribed on the face of the front cover. These latter indicia are used by players in scoring when playing the aformentioned dart game of cricket.

As can be seen in FIG. 3, seven of the cricket scoring modules 46 of the type shown in FIG. 4 are stacked inside each of the cricket module compartments 36 and 36' and are aligned with the windows 26 and 26' when the front cover 19 is attached to the game board 10 with the fasteners 20.

Figure 8:
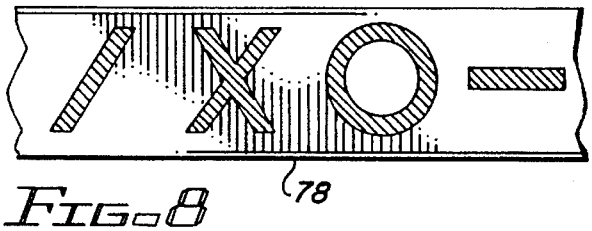
FIG. 8 is a plan view of an endless belt adapted to circumvent the spool of FIG. 4 and having illustrated thereon indicia useful in scoring the dart game of cricket.
Figure 10:
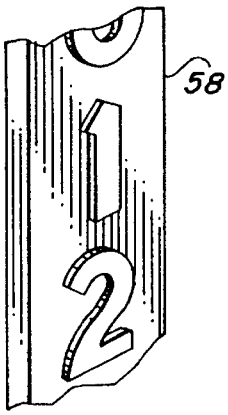
FIG. 10 is a perspective view of an endless belt of a type useful in circumventing the spools of FIGS. 6 and 7.

The construction of a typical one of the cricket scoring modules 46 is illustrated in FIGS. 4,5 and 11. Each module 46 is comprised of a single spool 74 having a knurled shoulder 76 on each end thereof for retaining an elastic indicia ring 78. The ring 78 can be fabricated from the same types of materials as previously described for the endless belt 58 so that the ring 78 can be stretched around the outer circumference of the spool 74. The indicia of ring 78, may be imprinted, embossed or otherwise affixed to the ring in the same manner as described for the belt 58. As shown in FIG. 8, these indicia are made up the characters or legends /,X,0,–. A blank, (i.e., a space without a legend) may be used to replace the – legend between the 0 and /. These legends have been chosen by the inventor to have specific meanings useful in playing the dart game of cricket. The meanings of these legends will subsequently be described. However, it is understood that other legends may be used, the legends shown being merely illustrative examples. It is obvious that the ring 78 can be eliminated from the module 46. If the ring is eliminated, then the spool 74 can be provided with the above described indicia imprinted or otherwise affixed around the outer circumference of the spool to thus replace the indicia normally present on the ring 78.

The modules 46 are each further comprised of a spool holder 80 of a second type as best shown in FIGS. 4 and 11. The spool holder 80 is preferably of rectangular tube construction and contains holes or apertures 82 axially formed in opposite walls of the holder. The spool 74 has an aperture or bearing surface 84 extending lengthwise therethrough. During assembly of the module 46, the spool 74, with attendant ring 78, is inserted into the holder 80. The bearing aperture 84 is then aligned with the holes 82 and the axle pin 86 is inserted through the holes 82 and bearing surface 84, to thus retain the spool inside the holder 80. The axle pin 86 is sized to slide into the holes 82 under slight pressure to hold the spool in place within the holder. To enable the spool 74 to be rotated to change the display of the various indicia through the windows 26 and 26', the inside diameter of the axle bearing surface 84 of the spool is slightly larger than the outside diameter of the pin 86.

Referring now to FIGS. 4 and 5, it can be seen that the holes 82 are positioned off center to be closer to one end of the holder 80. As can be seen, this positioning allows the knurled shoulders 76 of the spool to extend a specified amount beyond that one end of the module 46. The shoulders 76 are provided with knurling 88 in a manner similar to that described for the spools 54 of the modules 34. The extension of the spool beyond the end of the holder 80 is sufficient to allow the knurling 88 to protrude through each of the window openings 26 and 26' when the modules are inserted into compartments 36 and 36', to thus allow a player or score keeper to rotate the spool 74 in each of the window openings 26 during the play of cricket.

In the preferred embodiment, scoring modules 34 and 46 are made of injection or compression molded plastic parts, except for the elastic belt 58. However, other suitable materials, such as wood or metal could also be used.

When a standard game of darts is to be played, the first row of numbers in each of the arrays 24 and 24' are adjusted by each player, or the score keeper, to the number for that game. In FIG. 1, that number is shown for the game of 601. At the start of the game, the second and third rows of each array are set to 000.

As previously described, the object in the standard game of darts is for each player to get rid of the points. In the example shown, reduce 601 to 000. The first player to achieve 000 is the winner. In play, each player takes a turn throwing a set of three darts at the dart board. After each set, that player registers his intermediate score on his designated one of the arrays 24 or 24'.

To simplify the description of how the score board of the invention is used to keep score, the operation of only one score keeping module 24 will be described. Let it be assumed that the player using the left hand array of FIG. 1 has just thrown his first set of darts and registers a score of 70. This score of 70 is shown in the second row of the array 24. The score of 70 is then subtracted from the number (601) in the first row by the player, or score keeper, to provide an intermediate score of 531 in the third row of the array 24 as shown in FIG. 1. Now, by rotating the spools 54 with knurls 59, the number in the third row is transferred to the first row and the third row is reset back to zero. Thus, the 601 in the first row becomes 531 to reflect the latest intermediate score and the third row is reset for the next subtraction to derive the next intermediate score.

Let is now be assumed that the same player, after his opponent has taken his turn, scores 61 with his next set of darts. That score is now entered into the second row by rotating the spools and thus the endless belt, to register 61 in the windows of that row. The number 61 is now subtracted from 531 in the first row to provide the next intermediate score of 470 in the third row. The number (i.e., intermediate score of 470) in the third row is then transferred to the first row, and the third row is again reset to 000 as previously described.

The above described procedure is repeated by each player continuing to throw their respective sets of darts until one of the players reduces his final (intermediate) score to 000, which gets registered in the third row of the array of the winning player. Before a player can actually win the game, he must throw a double. For the details of how the various games of darts are played, reference is made to the aformentioned book entitled—All About Darts.

A brief illustrative description of how the score board of the invention is used to play the dart game of cricket will now be described, the purpose being to merely show how the indicia on the spools 74 and 54 are used for scoring. However, prior to proceeding with the description, it is first believed advantageous to explain the purpose of the indicia (numbers 15–20 and the letter C) shown in FIG. 1.

Each number (15–21 and C) shown in FIG. 1 represents scoring possibilities for each player. Those skilled in the art will recognize these numbers as numbered pies on a dart board. The letter C stands for the center or bullseye on the dart board. In each of those pies, doubles and trebles are worth their normal values as in the standard game of darts. In order for a player to begin scoring points in the game of cricket, that player must score a triple on one of the numbered pies (15–20). This is accomplished by a player throwing darts to score either a triple, or a double and a single, or three singles into a pie. When a player has scored three darts into a specific pie, that number corresponding to that pie is said to be brought alive by that player. The player bringing a number alive can then score on that number by throwing darts into the pie corresponding to that number. When a player brings a number alive, his opponent is said to be closed out for that number. That is, the opponent cannot score on that number. However, the opponent can kill that number, thus making that number dead and removing it from the game, by throwing three darts into the corresponding pie of that number.

The invention provides means for keeping track of the alive and dead numbers, as well as how many darts have been thrown by each player into each of those numbers prior to bringing a number alive or killing the number. The indicia, or symbols, on the band of the cricket spools 74, as shown in FIG. 8, provide this means. In FIG. 8, the symbols on the band 78, when displayed through the two columns of windows 26 and 26', represent the following: (i) the – means that number has not been brought alive by any player. All of the spools 74 are adjusted to display the – at the beginning of the game; (ii) the \ means that a player has thrown one dart into the number corresponding to that pie; (iii) the X means that a player has thrown two darts into the pie corresponding to that number; and (iv) the 0 means that a player has thrown three darts into the pie corresponding to that number, thus bringing that number alive and shutting out his opponent from scoring using that number. The bullseye (C) is used to close out a game. A player must score three bullseyes in order to win a game. However, a player cannot win a game unless his opponent has been shut out of scoring in any pies.

The score, when playing cricket using the invention, is kept by each player using one of the rows of the adjustable scoring modules 34 in each of the arrays 24 and 24'. By agreement of the players, anyone of the three rows in each array can be used for scoring. Generally, the first row of each array is used, with one player using row one of array 24 and his opponent using row one of array 24'. The player using array 24 of course uses the windows in column 72 for keeping track of the pies related to his play and his opponent likewise uses array 24' and the windows in column 72'.

The game of cricket is always started with the arrays 24 and 24' set to display 000 for each player. The indicia in columns 72 and 72' are set to display the symbol - in window openings 26 and 26'. The players take turns, with each player throwing a set of three darts. Let it be assumed that the player using array 24 starts the game and throws a triple twenty with his first dart. That player then rotates the spool in column 72 to the left of the number 20 to display the 0, thus bringing the number, 20 alive and shutting his opponent out from scoring on that number. Let it further be assumed that that same player now scores 40 with his next two darts by throwing singles into the number 20 pie. That player now rotates the spools 54 in row one of array 24 to display his score of 40.

The turn now passes to his opponent who will attempt to bring alive any number of his choosing by throwing his set of three darts. If the opponent brings a number alive (such as 19), he then sets the indicia to the right of that number to 0 as previously described. He is now able to score points by throwing his darts at the number 19 pie.

Play will resume as described above, with each player taking his turn while attempting to bring numbers alive, or kill numbers, while increasing his core by adding his last score to his previous score to thus maintain a running score for each player on the first row of numbers of each players designated array. When all of the numbers 15–20 have been brought alive, the player with the most alive numbers is said to have shut his opponent out of pies, thus that player is in a position to win the game. However, in order for that player to win, he must score three bullseyes and register the number of those bullseyes in that player's window (26 and 26') adjacent the C. A double bullseye is achieved by the player throwing a dart dead center in the dart board bullseye. A double bullseye is registered by rotating the spool 74 next to the letter C to display X. A single bullseye is scored by the player throwing a dart in the first ring outside the bullseye on the dart board. A single bullseye is displayed as a / in the opening 26 next to the letter C. Three bulleyes are registered by displaying the O in the window opening of the winning player.

The subject invention has been described with reference to certain embodiments. It will be understood by those skilled in the art to which this invention pertains that the scope and spirit of the appended claims should not necessarily be limited to the embodiments described in detail herein.

What is claimed is:

1. A dart game score board, comprising:

(a) a case having a front cover and including at least one walled compartment therein, one wall of which is formed by at least a portion of said front cover and at least orthogonal array of at least three rows and three columns of window openings; and (b) a plurality of scoring modules, equal in number to the number of said window openings, each of said scoring modules including an elongated substantially U shaped spool carrier, each spool carrier having side walls, said side walls having oppositely disposed bearing surfaces formed in axial alignment adjacent each end thereof, a pair of spools for each scoring module, each spool of said pair having first and second ends and each spool having an axle extending from the first and second ends respectively thereof, and each spool being rotatably mounted with the axle at each of the first and second ends of each spool in a corresponding one of the bearing surfaces of said spool carrier, each pair of spools having an endless belt, with scoring indicia thereon, circumventing each pair of spools and being in frictional engagement therewith, said plurality of scoring modules, when inserted in said at least one compartment forming an orthogonal array of indicia aligned with the window openings in the front cover of said case with a portion of a spool of each module extending through a corresponding window opening in said front cover, whereby said spools and said endless belt of each scoring module may be individually rotated to thus display the scoring indicia in the window openings for keeping score when playing a game of darts.

2. A dart board score board, comprising:

(a) a case, said case having a front cover and including, inside thereof, at least one walled compartment, one wall of which is formed by a portion of said front cover and said portion of said front cover having formed therein a plurality of window openings; and (b) a plurality of scoring modules, equal in number to said plurality of window openings, each of said scoring modules being comprised of, at least a spool retainer, a pair of spools and an endless belt having scoring indicia thereon, said spool retainer having opposite ends, means at each end of said spool retainer for mounting a spool, said means for mounting including means for axially holding a spool at each end of said spool retainer, said endless belt being disposed in frictional engagement around said pair of spools, whereby, when a one of said spools is rotated, said endless belt rotates with said pair of spools, said plurality of scoring modules, when inserted in said compartment having one spool of each scoring module disposed within a corresponding one of said window openings in said front cover with the scoring indicia of each endless belt visible through each corresponding window opening, whereby said pair of spools and said endless belt of each module may be individually rotated to display, in the window openings, dart game scores.

3. A dart game score board, comprising:

(a) a case, said case having a front cover, first and second portions of said front cover each having a group of window openings formed therein, said case further including inside thereof, first and second walled compartments, one wall of each of said first and second walled compartments being formed by the window openings in the first and second portions respectively of said front cover; and (b) first and second arrays, each array including a group of scoring in a corresponding one of said first and second portions, respectively, in said front cover, each of said scoring modules being comprised of, a spool retainer, a pair of spools and an endless belt having indicia thereon for registering dart scores, said spool retainer having opposite ends, means at each end of said spool retainer for mounting a spool, said means for mounting including means for axially holding a spool at each end of said spool retainer, said endless belt being disposed in frictional engagement around said pair of spools, whereby, when a spool is rotated, said endless belt rotates with said pair of spools, each group of said scoring modules being inserted in said first and second compartments to form said first and second arrays with a spool on each of said scoring modules being disposed within a corresponding one of the window openings in said first and second portions in said front cover, whereby said pair of spools and the endless belt of each scoring module may be individually rotated to thus display indicia in the group of window openings in said first and second portions of said front cover to thus register dart game scores.

4. A dart game score board, comprising:

(a) a case, said case including, inside thereof, at least first and second walled compartments, said case having a front cover having formed therein at least one orthogonal array of window openings and at least one column of window openings;

(b) a plurality of scoring modules of a first type, equal in number to said at least one orthogonal array of window openings, inserted in said first walled compartment, each of said scoring modules of said first type having, at opposite ends thereof, axially aligned bearing surfaces, first and second spools of a first type, each having an axle extending therethrough, the axle of each spool of said first type being axially disposed in a corresponding one of the bearing surfaces at the ends of each of said scoring modules of said first type, each of said scoring modules of said first type further including an endless belt, having indicia thereon, frictionally disposed around the first and second spools thereof, one spool of said first type of each of said plurality of scoring modules of said first type being aligned with and extending through a corresponding one of the window openings in the orthogonal array of window openings in said front cover, whereby the spool of said first type extending through those window openings are individually rotatable from the front of said dart game score board, to thus display, in those window openings, the indicia on the endless belt of each scoring module of said first type for the purpose of registering the scores of different dart games; and (c) a plurality of scoring modules of a second type, equal in number to the number of window openings in said at least one column of window openings in said front cover, inserted in the second walled compartment, each of said scoring modules of said second type including a spool of a second type having an axle extending from each end thereof and further including a spool holder having means for receiving the axle at each end of said spool of said second type for axial rotation within said spool holder, said spool of said second type further having symbols around the outer circumference thereof, the spool of said second type of each of said scoring modules of said second type being aligned with and extending through a corresponding one of the window openings in said at least one column of window openings in said front cover, whereby said spools of said second type are individually rotatable from the front of said dart game score board, to thus display, in said at least one column of window openings, said symbols for the purpose of playing a specific type of dart game.

5. The dart game score board according to claim 4, wherein said scoring modules of said first type each includes a spool retainer having said axially aligned bearing surfaces at each end thereof for axially mounting a spool of said first type, the axle of each spool of said first type being retained in said axially aligned bearing surfaces at each end of said spool retainer by said endless belt being stretched around said spools of said first type.

6. The dart game score board according to claim 5, wherein said scoring modules of said first type each further includes a spool holder in which said spool retainer is mounted.

7. The dart game score board according to claim 5, wherein said endless belt is fabricated of elasticized material having the numerals 0 through 9 imprinted thereon.

8. The dart game score board according to claim 4, wherein said spool of said second type has the symbols -,/,X and 0 imprinted thereon, said symbols being used for playing the dart game of cricket.

9. The dart game score board according to claim 8, wherein said front cover has imprinted thereon a plurality of numbers, each number representative of a specified segment on a dart board, with a different number being imprinted adjacent a corresponding one of the window openings in said at least one column of window openings, said symbols -,/,X and 0, when displayed in a window opening being representative of the number of darts thrown by a player into that dart board segment corresponding to the number adjacent the window opening.

10. The dart game score board according to claim 9, wherein said at least one orthogonal array of window openings consists of at least three rows and three columns for keeping dart game scores and displaying such scores during play, the three rows and columns of window openings being designated for playing the standard game of darts and at least one row of window openings being designated for keeping score when playing the dart game of cricket.

* * * * *